United States Patent [19]

Daniels

[11] 4,405,100

[45] Sep. 20, 1983

[54] TURBULENCE GENERATOR FOR MAXIMIZING CONFIGURATION TOLERANCES OF FREE FLIGHT ORDNANCE

[75] Inventor: Peter Daniels, Fredericksburg, Va.

[73] Assignee: The United States of America as represented by the Secretary of the Navy, Washington, D.C.

[21] Appl. No.: 236,480

[22] Filed: Feb. 20, 1981

[51] Int. Cl.[3] ..... F42B 25/20; F42B 13/00

[52] U.S. Cl. ..... 244/3.1; 102/293; 102/382; 102/501

[58] Field of Search ..... 102/382, 385, 393, 293, 102/501, 526; 244/3.1, 3.24

[56] References Cited

U.S. PATENT DOCUMENTS

| | | | |
|---|---|---|---|
| 1,557,082 | 10/1925 | Newton | 102/382 |
| 2,315,145 | 3/1943 | Wauters | 244/3.24 |
| 2,613,605 | 10/1952 | Brandt | 244/3.24 |
| 3,088,404 | 5/1963 | Brown et al. | 102/393 |
| 3,882,779 | 5/1975 | Frostig | 102/526 |
| 4,098,194 | 7/1978 | Miller et al. | 102/293 |

FOREIGN PATENT DOCUMENTS

| | | | |
|---|---|---|---|
| 259781 | 8/1928 | Italy | 102/382 |

*Primary Examiner*—Charles T. Jordan

*Attorney, Agent, or Firm*—R. S. Sciascia; A. L. Branning; W. R. Henderson

[57] ABSTRACT

A turbulence generator is provided on the forward end of a free flight ordnance device to induce a turbulent boundary layer over the surface of the device. The turbulent layer generated is thicker than the normal boundary layer and helps reduce drag disparity between similar ordnance devices.

1 Claim, 4 Drawing Figures

TURBULENCE GENERATOR FOR MAXIMIZING CONFIGURATION TOLERANCES OF FREE FLIGHT ORDNANCE

BACKGROUND OF THE INVENTION

The present invention relates to a turbulence generator provided on the forward end of free flight ordnance devices such as bombs or other weapons. Previously, free flight ordnance devices have required that the outer surface be machined to close tolerances to insure that drag differences between similar ordnance devices are minimal.

Drag disparity between similar ordnance devices is caused by variations in the outer surface curvature, roughness, and configuration tolerances. These variations in surface characteristics affect the drag of each device in an uneven manner. This drag disparity produces varying range for similar free flight ordnance and results in reduced accuracy.

SUMMARY OF THE INVENTION

Accordingly, there is provided in the present invention a turbulence generator positioned on the forward end of a free flight ordnance device so as to induce a turbulent boundary layer surrounding the outer surface of the device. The turbulent boundary layer is thicker than the normal boundary layer and reduces the difference in drag from device to device.

The turbulence generator is provided in the form of a raised circular ring positioned on the forward end of the device or bomb. The turbulence generator may also be in the form of a circular groove or series of circular grooves positioned in the forward end of the device.

OBJECTS OF THE INVENTION

It is an object of the present invention to reduce the drag disparity between free flight ordnance devices.

It is a further object of the present invention to reduce drag disparity in similar free flight ordnance devices by minimizing differences in surface friction.

It is a still further object of the present invention to reduce outer surface tolerance requirements in free flight ordnance devices.

It is yet another object of the present invention to reduce drag disparity in free flight ordnance devices by reducing the effect of surface variations.

Other objects, advantages, and novel features of the present invention will become apparent from the following detailed description of the invention when considered in conjunction with the drawings.

BRIEF DESCRIPTION OF THE DRAWINGS

A more complete appreciation of the invention and many of the attendant advantages thereof will be readily understood by reference to the following detailed description when considered with the accompanying drawings in which like reference numerals designate like parts throughout the figure and wherein.

DESCRIPTION OF THE PREFERRED EMBODIMENT

Figure 1:
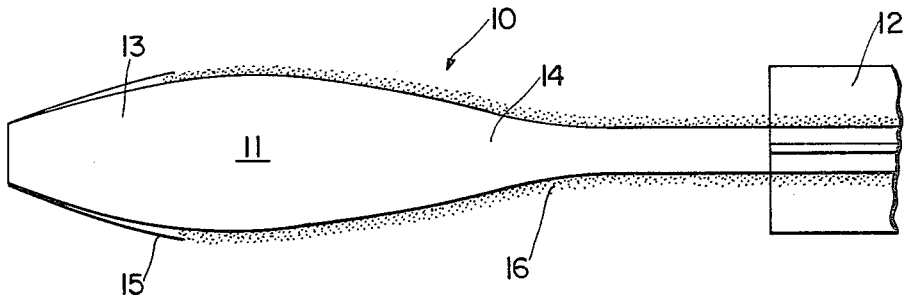
FIG. 1 illustrates a schematic of a free flight ordnance device.

Referring to FIG. 1, there is illustrated a side view of a free flight ordnance device 10. The ordnance device or bomb is provided with a streamlined body 11 having a forward end 13 and an after end 14. After end 14 is provided with a tail assembly 12. As shown in FIG. 1, the ordnance device, after launching from a launch platform such as an aircraft, is surrounded by a flow layer from the forward end to the after end of body 11. The flow layer is formed with a laminar flow portion 15 and a turbulent flow portion 16. The transition point between the laminar flow boundary layer and the turbulent flow boundary layer affects the drag of the device and is dependent on the surface characteristics of the individual ordnance device. As the surface characteristics vary from device to device, due to variations in surface curvature, roughness and tolerance, the drag on each device also varies, thus creating a drag disparity between similar devices.

Figure 2:
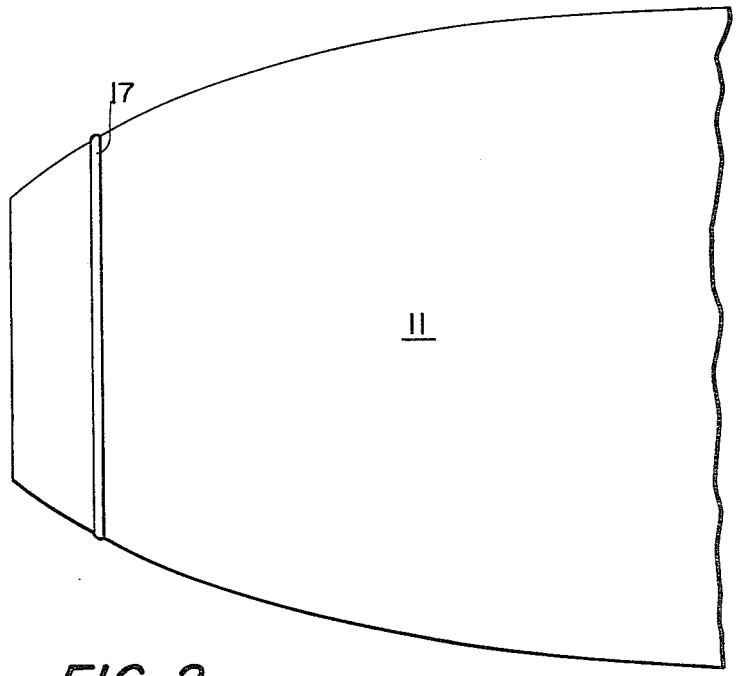
FIG. 2 illustrates a schematic of the forward portion of the ordnance device of FIG. 1 having the turbulence generator of the subject invention.

There is illustrated in FIG. 2 a first embodiment of the turbulence generator of the subject invention. The turbulence generator is constructed in the form of a circular ring 17 positioned on forward end 13 of ordnance device 10 so as to project into the airstream and create a transition point for the formation of the turbulent boundary layer. Ring 17 is machined to a close tolerance on each device and thus allows surface variations from device to device without creating drag disparity.

Figure 3:
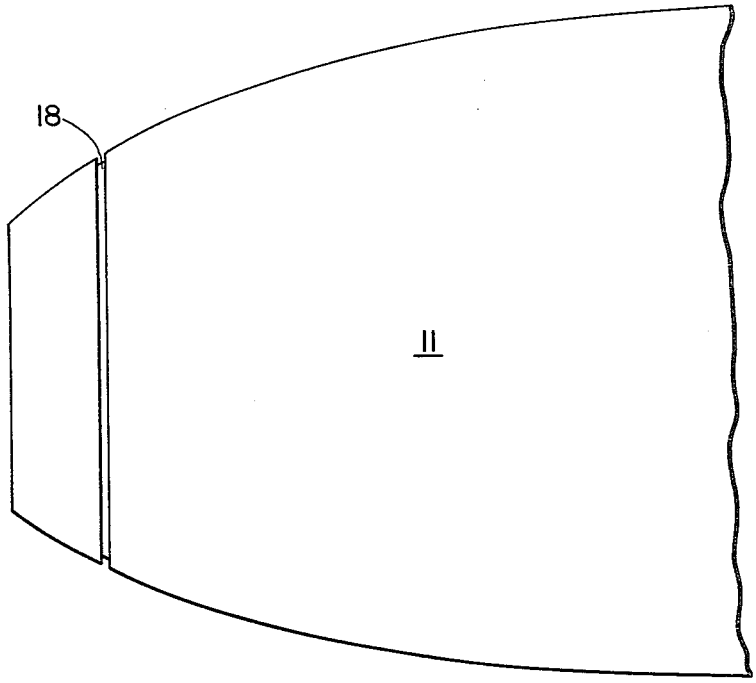
FIG. 3 illustrates a second embodiment of the subject invention.

Referring to FIG. 3 there is illustrated a second embodiment of the turbulence generator of the subject invention. The generator is formed by means of a circular groove 18 positioned in forward end 13 of ordnance device 10. As with the ring 17, circular groove 18 forms a transition point in the airstream for the turbulent boundary layer and is machined to a close tolerance. Both ring 17 and groove 18 act to minimize the drag disparity between similar free flight ordnance devices. The boundary layer created by the turbulence generator eliminates the random location of the transition point from laminar flow to turbulent flow and does minimize and standardize the drag due to surface curvatures, roughness and configuration tolerances.

Figure 4:
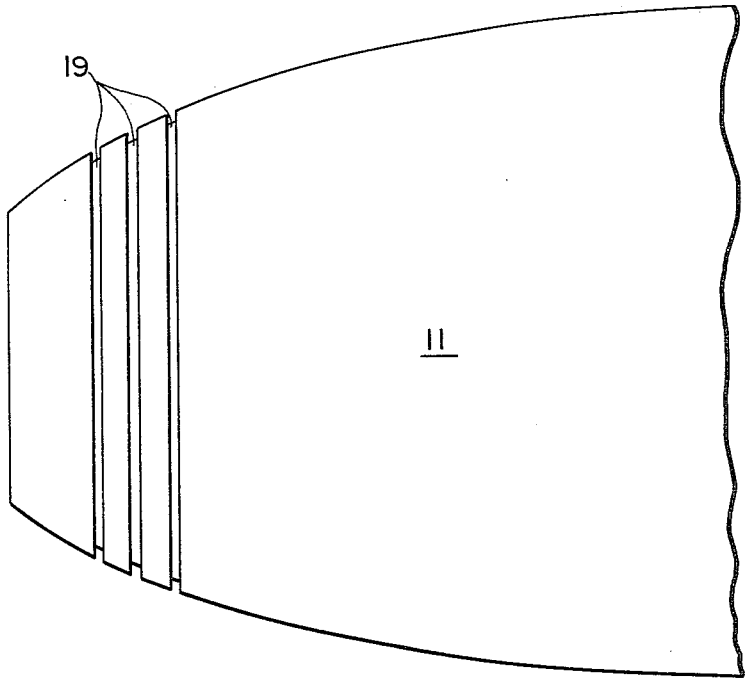
FIG. 4 illustrates a third embodiment of the subject invention.

FIG. 4 illustrates a third embodiment of the subject invention in the form of a series of grooves 19 positioned in the forward portion of ordnance device 10. The series of grooves 19 are machined to a close tolerance so as to function in the same manner as ring 17 and groove 18 to reduce drag disparity between similar ordnance devices.

The result of the turbulence generators disclosed in FIGS. 2 through 4 is to reduce drag disparity between similar ordnance devices by reducing the effects of variations in surface characteristics from device to device.

It is thus apparent that the disclosed turbulence generator provides a means for improving the accuracy of free flight ordnance by reducing the drag disparity of similar ordnance devices. The generator minimizes skin friction effects on the drag of the device and allows devices to be manufactured with variations in surface curvature, roughness and tolerance without substantially impairing the accuracy of the devices due to drag disparity.

Many obvious modifications and embodiments of the specific invention other than those set forth above will readily come to mind to one skilled in the art having the benefit of the teachings presented in the foregoing description and the accompanying drawings of the subject invention and hence it is to be understood that such modifications are included within the scope of the appended claims.

I claim:

1. A method of reducing the variations in drag disparity between similar free flight ordnance devices caused by variations in surface roughness and configuration so that each of said devices has substantially the same free flight range and accuracy comprising:

providing each device with a raised annular ring means at the same position on the front end of each device, in the laminar flow of air, where the position is on an essentially curved section of the front end wherein the ring means creates turbulent air flow and the ring means is machined to the same close tolerance dimensions on each device, for causing air flow past the device to change from laminar to turbulent at the same position on each device to reduce surface friction on each of said devices, the surface friction on each device being nearly equal due to the introduction of turbulent flow at the same position on each of said devices, thereby reducing the drag disparity therebetween and providing substantially the same free flight range for all devices.

* * * * *